US008210872B2

(12) United States Patent
Briant et al.

(10) Patent No.: US 8,210,872 B2
(45) Date of Patent: Jul. 3, 2012

(54) MOUNTING PLATE FOR MOUNTING AN ELECTRICAL CONNECTOR TO A CIRCUIT BOARD

(75) Inventors: Eric David Briant, Dillsburg, PA (US); Jodi Rae Peterson, New Buffalo, PA (US); Charles Jameson Valentine, Lancaster, PA (US); James Charles Schiffler, Hummelstown, PA (US); John Jacob O'Keefe, II, Lewisbury, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 55 days.

(21) Appl. No.: 12/841,322

(22) Filed: Jul. 22, 2010

(65) Prior Publication Data

US 2012/0021641 A1 Jan. 26, 2012

(51) Int. Cl.
*H01R 13/73* (2006.01)

(52) U.S. Cl. ..... 439/571; 439/566

(58) Field of Classification Search ..... 439/873, 439/571, 566, 567, 570, 751, 573
See application file for complete search history.

(56) References Cited

U.S. PATENT DOCUMENTS 5,249,983 A * 10/1993 Hirai ..... 439/573
5,259,789 A * 11/1993 Patel et al. ..... 439/570
6,042,420 A 3/2000 Long
6,053,767 A 4/2000 Copper et al.
6,478,617 B2 11/2002 Fan

* cited by examiner

*Primary Examiner* — Ross Gushi

(57) ABSTRACT

An electrical connector is provided including a housing. A mounting plate is provided having a mounting surface configured to be mechanically coupled to a circuit board. An opening extends through the mounting plate. The opening has an interior contour shaped to slidably receive a post of the housing as the mounting plate is loaded onto the post until the mounting plate rests on a plate surface of the housing. An engagement feature is provided on the mounting plate. The engagement feature secures the mounting plate to the housing. The engagement feature displaces a plate securing portion formed on the housing to secure the mounting plate to the housing with an interference fit.

19 Claims, 8 Drawing Sheets

MOUNTING PLATE FOR MOUNTING AN ELECTRICAL CONNECTOR TO A CIRCUIT BOARD

BACKGROUND

The subject mater herein relates generally to electrical connectors and, more particularly, to a mechanism for mounting an electrical connector to a circuit board.

Electronic assemblies such as servers, routers, and data storage systems generally include multiple circuit boards, for example, backplane or midplane circuit boards, motherboards, and/or daughter cards. Electrical connectors are configured to engage the circuit boards to enable electrical components to be connected thereto. The connectors are both mechanically and electrically coupled to a surface of the circuit board. Electrical connections may be made by joining electrical contacts on the circuit board with electrical contacts on the connector. The connector may include a coupling mechanism that engages a corresponding mechanism on the circuit board. The coupling mechanism provides a mechanical connection between the connector and the circuit board to retain the connector on the circuit board.

However, conventional electrical connectors experience certain disadvantages. The coupling mechanism provided on the connector is often positioned proximate to a back end of the connector. The connector generally includes a front mating end that is configured to receive an electrical component. The electrical component is typically joined to the connector after the connector has been secured to the circuit board. Coupling the electrical component to the mating end of the connector generates a force in a direction substantially parallel to the surface of the circuit board. When the connector is only coupled to the circuit board at the back end of the connector, the force may generate a torque on the connector. The torque rotates the connector with respect to the circuit board, thereby causing the coupling mechanisms at the back end of the connector to become disengaged from the circuit board.

A need remains for a mechanism to improve the mechanical connection between an electrical connector and a circuit board.

SUMMARY OF THE INVENTION

In one embodiment, an electrical connector is provided. The electrical connector includes a housing having a mating end and a back end. The housing has a plate surface extending between the mating end and the back end. A post extends from the plate surface and is configured to mount within an aperture provided on the circuit board. A mounting plate is provided having a mounting surface configured to be mechanically coupled to the circuit board. An opening extends through the mounting plate. The opening has an interior contour shaped to slidably receive the post as the mounting plate is loaded onto the post until the mounting plate rests on the plate surface of the housing. An engagement feature is provided on the mounting plate. The engagement feature secures the mounting plate to the housing. The engagement feature displaces a plate securing portion formed on the housing to secure the mounting plate to the housing with an interference fit.

In another embodiment, an electronic assembly is provided. The assembly includes a circuit board having a surface and an aperture extending through the surface. An electrical connector is provided including a housing having a mating end and a back end. The housing has a plate surface extending between the mating end and the back end. A post extends from the plate surface and is configured to mount within the aperture of the circuit board. A mounting plate is provided having a mounting surface configured to be mechanically coupled to the circuit board. An opening extends through the mounting plate. The opening has an interior contour shaped to slidably receive the post as the mounting plate is loaded onto the post until the mounting plate rests on the plate surface of the housing. An engagement feature is provided on the mounting plate. The engagement feature secures the mounting plate to the housing. The engagement feature displaces a plate securing portion formed on the housing to secure the mounting plate to the housing with an interference fit.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
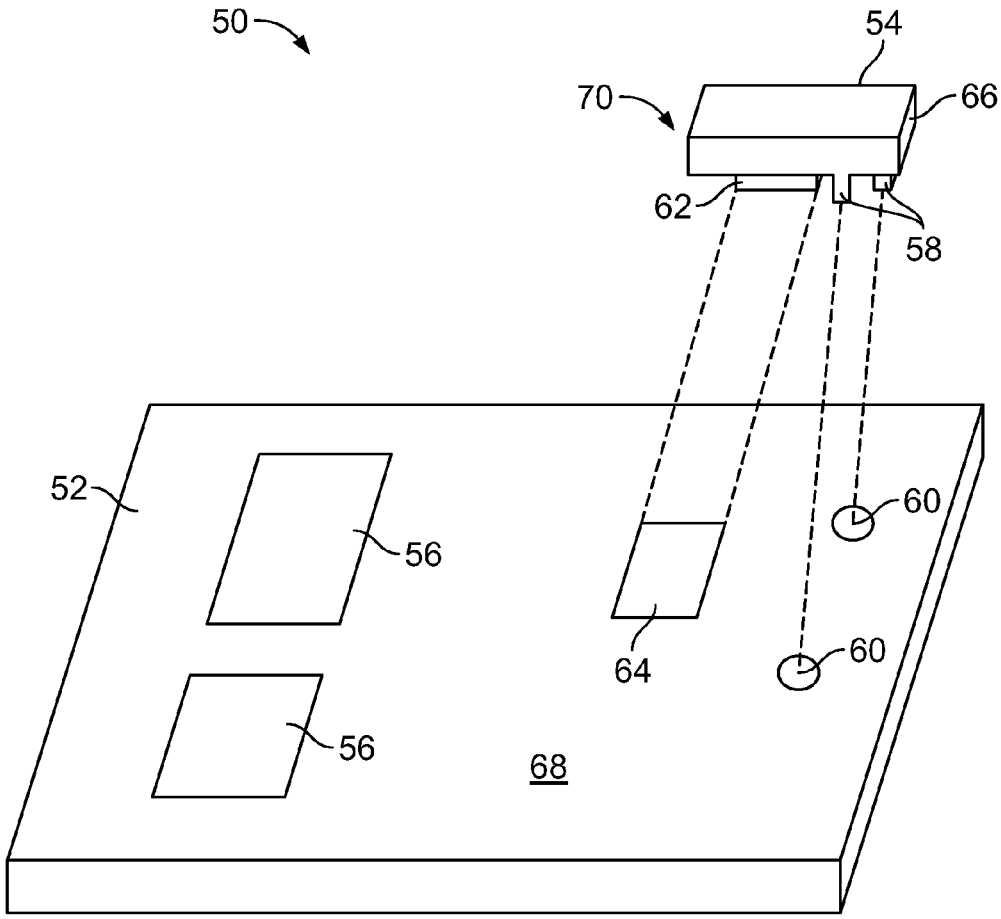
FIG. 1 illustrates an exploded view of an electronic assembly.

FIG. 1 illustrates an exploded view of an electronic assembly 50. The electronic assembly 50 may be a server, a router, a data storage system, or the like. The electronic assembly 50 includes a circuit board 52 and an electrical connector 54. The circuit board 52 may be a backplane or a midplane circuit board, a motherboard, or a daughter card. The circuit board 52 includes a surface 68 having a plurality of electrical components 56 coupled thereto. The electrical components 56 may transmit data and/or power signals across the circuit board 52. The electrical components 56 may be joined to an electrical contact of the circuit board 52, for example, electrical contact 64. The connector 54 includes an electrical contact 62 that is configured to engage the electrical contact 64 of the circuit board 52.

The connector 54 includes posts 58 that are configured to be mounted in the circuit board 52. The circuit board 52 includes apertures 60 that receive the posts 58. The apertures 60 are positioned to align the electrical contact 62 of the connector 54 with the electrical contact 64 of the circuit board 52 to electrically join the connector 54 and the circuit board 52. The connection between the posts 58 and the apertures 60 mechanically joins the connector 54 and the circuit board 52. Alternatively, the posts 58 and the apertures 60 may include electrical contacts to electrically engage the connector 54 and the circuit board 52.

The connector 54 includes a mating end 66 and back end 70. The back end 70 may include a coupling mechanism to mechanically engage the connector 54 and the circuit board 52. The mating end 66 is configured to receive an electrical component, for example, a transceiver. The electrical component is coupled to the mating end 66 in a direction that is parallel to the surface 68 of the circuit board 52. A force may be generated on the connector 54 in a direction parallel to the surface 68 of the circuit board 52. The posts 58 counteract the force on the connector 54 to retain the connector 54 on the circuit board.

Figure 2:
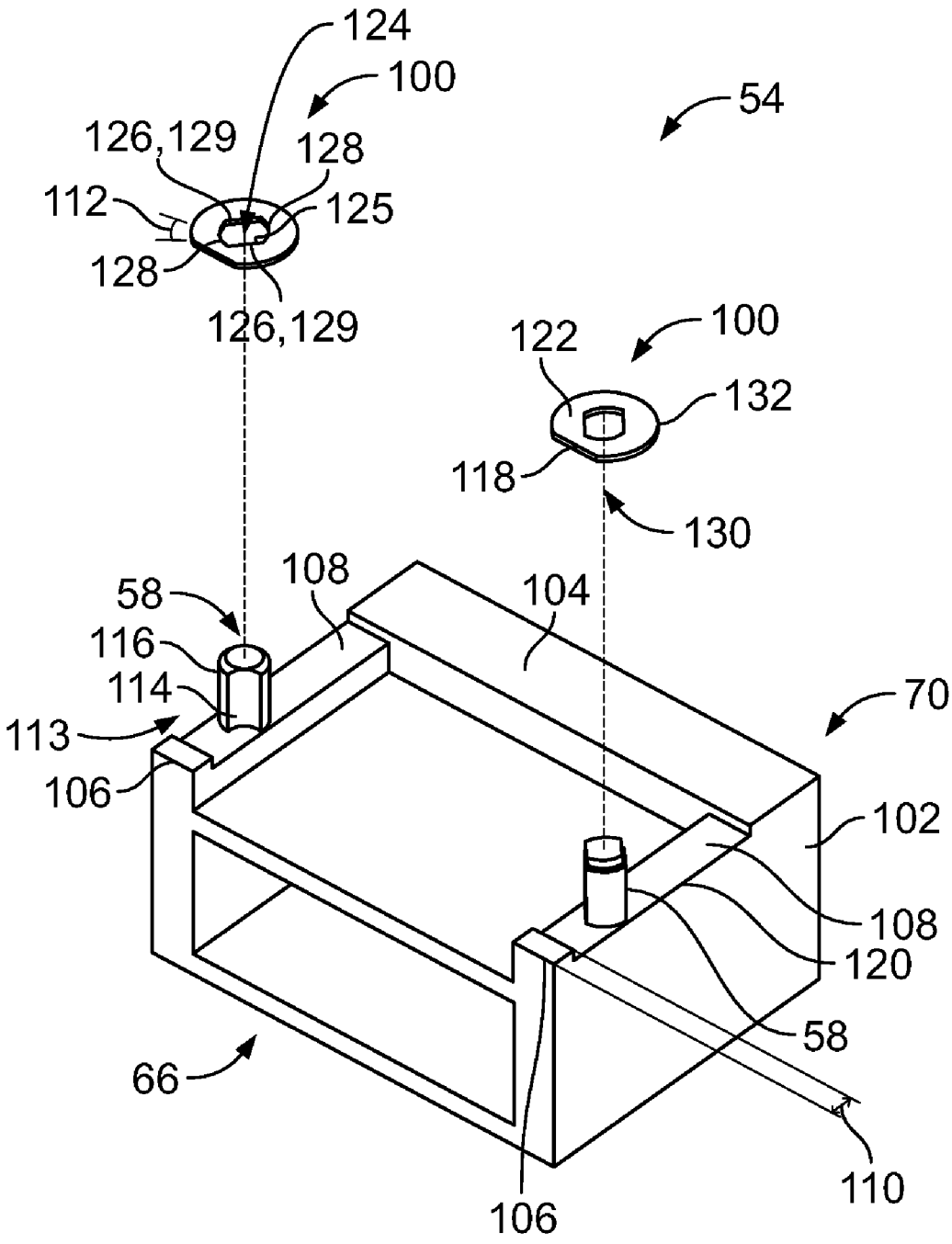
FIG. 2 illustrates a bottom perspective view of the connector, shown in FIG. 1, and mounting plates in a pre-assembled position.

FIG. 2 illustrates the electrical connector 54 and a pair of mounting plates 100 in a pre-assembled position. The mounting plates 100 are configured to be positioned between the connector 54 and the circuit board 52 when the connector 54 is coupled to the circuit board 52. The mounting plates 100 are positioned on the posts 58 to provide a surface for mechanically joining the connector 54 to the circuit board 52. For example, the mounting plate 100 may provide a surface for soldering the connector 54 to the circuit board 52. The mounting plates 100 are configured to couple to the connector 54 through an interference fit.

The connector 54 includes a housing 102 with a rear mounting surface 104 proximate to the back end 70 and a pair of front mounting surfaces 106 proximate to the mating end 66. The mounting surfaces 104 and 106 are positioned in a planar relationship. The mounting surfaces 104 and 106 are configured to be positioned on a surface of the circuit board 52. The mounting surfaces 104 and 106 may be planar for positioning on a planar circuit board 52. Alternatively, the mounting surfaces 104 and 106 may be contoured to position on corresponding contours of the circuit board 52. In one embodiment, the mounting surfaces 104 and 106 may include coupling mechanisms, for example, notches, slots, tabs, and the like, that engage corresponding mechanisms on the circuit board 52.

A plate surface 108 extends along the housing 102 between the mating end 66 and the back end 70. The plate surface 108 steps down from each of the surfaces 104 and 106. The surfaces 104 and 106 are positioned a distance 110 from the plate surface 108. The plate surface 108 is configured to receive a mounting plate 100 thereon. The plate surface 108 may be planar to engage a planar mounting plate 100. Alternatively, the plate surface 108 may include coupling mechanisms, for example, notches, slots, tabs, and the like, that engage corresponding mechanisms on the mounting plate 100. In an embodiment, the mounting plate 100 has a height 112 that is equal to the distance 110 between the mounting surfaces 104 and 106 and the plate surface 108. When the mounting plate 100 is positioned on the plate surface 108, the mounting plate 100 and the mounting surfaces 104 and 106 are aligned in a planar relationship.

The posts 58 extend from the plate surface 108. A single post 58 is illustrated on each plate surface 108. Alternatively, either plate surface 108 can have any number of posts 58. One of the plate surfaces 108 may not include a post 58. In another embodiment, posts 58 may extend from either of the mounting surfaces 104 and 106 and/or any other portion of the housing 102. The orientation and number of posts 58 is configured to correspond to an orientation and number of apertures 60 formed in the circuit board 52. In one embodiment the posts 58 form mechanical connections with the circuit board 52. Optionally, the posts 58 may include electrical contacts that are configured to electrically engage the circuit board 52.

The posts 58 have a non-uniform contour 113. The non-uniform contour 113 includes a pair of first contours 114 and a pair of second contours 116. The posts 58 may include any number of first contours 114 and/or second contours 116. Each first contour 114 is positioned between adjacent second contours 116. In the illustrated embodiment, the first contours 114 are linear and the second contours 116 are arcuate. Alternatively, the first contours 114 may have any non-linear shape that differs from the shape of the second contours 116. The second contours 116 may have any linear and/or non-linear shape that differs from the first contours 114. The first contours 114 and the second contours 116 are configured to differ so that each contour 114, 116 provides a different surface area around a perimeter of the post 58. At least one of the second contours 116 defines a plate securing portion 117 (shown in FIG. 3-5) of the housing 102.

The mounting plates 100 are discs having an outer contour 130. The outer contour 130 has a first edge 132 and a second edge 118. The first edge 132 is rounded and the second edge 118 is straight. The second edge 118 is configured to align with an edge 120 of the plate surface 108. Optionally, the mounting plates 100 may have any shape, for example squared, hexagonal, or the like. The mounting plates 100 have a mounting surface 122. The mounting plates 100 are configured to secure to the housing 102 of the connector 54 so that the mounting surface 122 extends along the plate surface 108 of the housing 102. The mounting surface 122 is planar and configured to engage the surface 68 of the circuit board 52. The mounting surface 122 provides a surface to mechanically couple the connector 54 to the circuit board 52. For example, the mounting surface 122 may provide a surface to solder the connector 54 to the circuit board 52. The mounting plates 100 may have a non-planar mounting surface 122. For example, the mounting surface 122 may be concave or convex. The mounting surface 122 may include protrusions, grooves, or the like. The mounting surface 122 may also include coupling mechanisms, for example, tabs, notches, slots, or the like, that engage corresponding coupling mechanisms formed on the circuit board 52.

The mounting plates 100 have an opening 124 extending therethrough. The mounting surface 122 extends around the opening 124. Optionally, the mounting surface 122 extends at least partially around the opening 124. The opening 124 is configured to slidably receive a post 58 to join the mounting plate 100 to the connector 54. The opening 124 is defined by a non-uniform contour 125. The non-uniform contour 125 includes pair of first contours 126 and a pair of second contours 128. The mounting plates 100 may include any number of first contours 126 and/or second contours 128. Each first contour 126 is positioned between adjacent second contours 128. In the illustrated embodiment, the first contours 126 are linear segments and the second contours 128 are arcuate segments. Alternatively, the first contours 126 may have any non-linear shape that differs from the shape of the second contours 128. The second contours 128 may have any linear and/or non-linear shape that differs from the first contours 126. The first contours 126 correspond to the first contours 114 on the post 58. The second contours 128 correspond to the second contours 116 on the post 58. An engagement feature 129 is defined by at least one of the first contours 126. The engagement feature 129 is configured to displace the plate securing portion 117 of the housing 102 to secure the mounting plate 100 to a post 58

The mounting plates 100 are configured to slide onto a post 58 with the contours 126 and 128 aligned with the contours 114 and 116, respectively. As described in more detail below, the mounting plate 100 is rotated so that the engagement feature 129 displaces the plate securing portion 117 from the post 58. The engagement feature 129 embeds within the post 58 to create an interference fit between the mounting plate 100 and the post 58.

Figure 3:
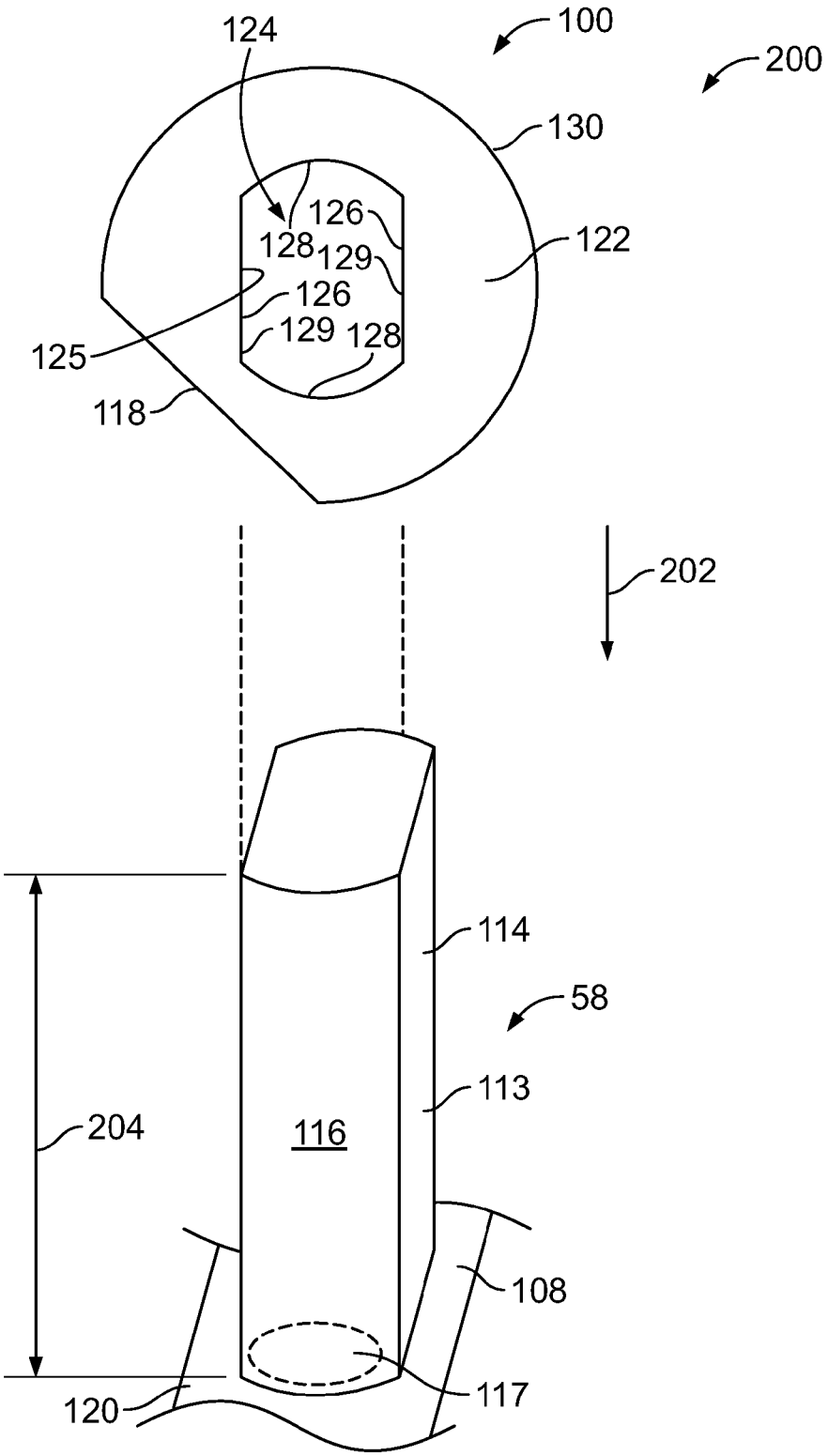
FIG. 3 illustrates a view of a mounting plate and a post, shown in FIG. 2, in a pre-assembled position.
Figure 4:
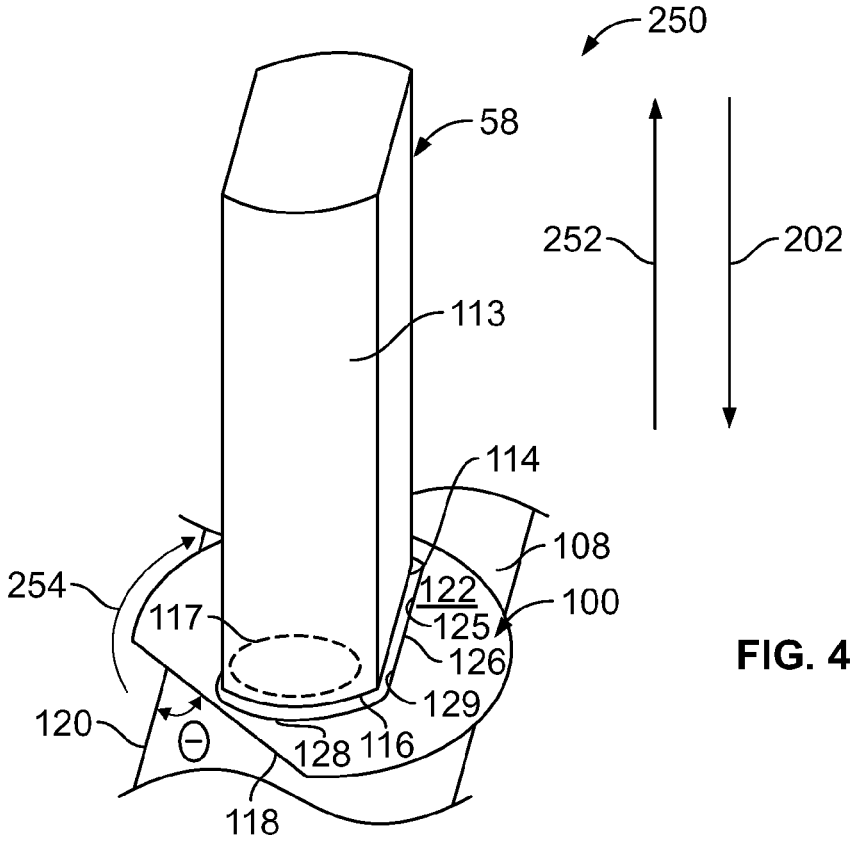
FIG. 4 illustrates the mounting plate and the post, shown in FIG. 3, in a loading position.
Figure 5:
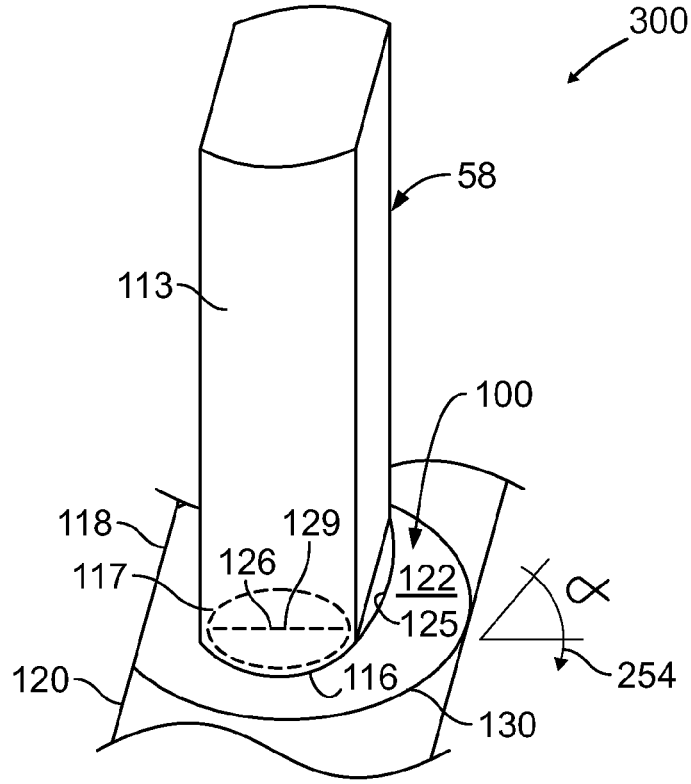
FIG. 5 illustrates the mounting plate and the post, shown in FIG. 4, rotated into an assembled position.

FIGS. 3-5 illustrate the engagement of a mounting plate 100 and a post 58. FIG. 3 illustrates a view of a mounting plate 100 and post 58 in a pre-assembled position 200. The contours 114, 116 of the post 58 are aligned with the contours 126 and 128 of the mounting plate 100. The mounting plate 100 is configured to move in the direction 202 so that the opening 124 receives the post 58. The contours 126, 128 are sized and shaped to receive the contours 114, 116. The mounting plate 100 is configured to slide a length 204 of the post 58. The mounting plate 100 rests in an unsecured position 250 (illustrated in FIG. 4) on the plate surface 108.

FIG. 4 illustrates the mounting plate 100 and the post 58 in the unsecured position 250. When in the unsecured position 250, the mounting plate 100 is engaged with and rests on the plate surface 108. The second edge 118 of the mounting plate 100 is misaligned with respect to the edge 120 of the plate surface 108. The second edge 118 is positioned at an angle θ with respect to the edge 120 of the plate surface 108. When in the unsecured position 250, the mounting plate 100 is moveably engaged with the post 58 such that the mounting plate 100 is capable of being moved away from the plate surface 108 in a direction 252. When in the unsecured position 250, the mounting plate 100 may also be moved in the direction 202 back into engagement with the plate surface 108.

The mounting plate 100 is also rotatably moveable with respect to the post 58 in the direction 254. Alternatively, the mounting plate 100 may be rotated in the direction opposite to the rotational direction 254. The mounting plate 100 is configured to rotate into an assembled position 300 (shown in FIG. 5). The mounting plate 100 rotates such that the engagement feature 129 displaces the plate securing portion 117 of the post 58. The engagement feature 129 is configured to create an interference fit with the post 58, when the mounting plate 100 is rotated into the assembled position 300.

FIG. 5 illustrates the mounting plate 100 and the post 58 in the assembled position 300. In the assembled position 300, the mounting plate 100 is rotated an angle α in the rotational direction 254 from the unsecured position 250. The angle α may be any angle between 10° and 180°. In an exemplary embodiment, the mounting plate 100 is rotated 90°. The second edge 118 of the mounting plate 100 is aligned with the edge 120 of the plate surface 108. Optionally, the outer contour 130 of the mounting plate 100 may have any orientation with respect to the edge 120 of the plate surface 108.

The engagement feature 129 of the mounting plate 100 is rotated into engagement with the post 58. The engagement feature 129 displaces the plate securing portion 117 of the post 58 so that the first contour 126 of the mounting plate 100 embeds within the second contour 116 of the post 58. The engagement feature 129 creates an interference fit with the post 58 to secure the mounting plate 100 to the post 58 and prevent movement in the direction 252 (shown in FIG. 4).

The mounting surface 122 of the mounting plate 100 provides a surface that can be mechanically coupled to the surface 68 of the circuit board 52. The mounting surface 122 is configured to engage the surface 68 of the circuit board 52. In one embodiment, the mounting surface 122 is soldered to the surface 68 of the circuit board 52. In another embodiment, the mounting surface 122 may include protrusions, tabs, notches, grooves, or the like the engage corresponding features on the surface 68 of the circuit board 52.

Figure 6:
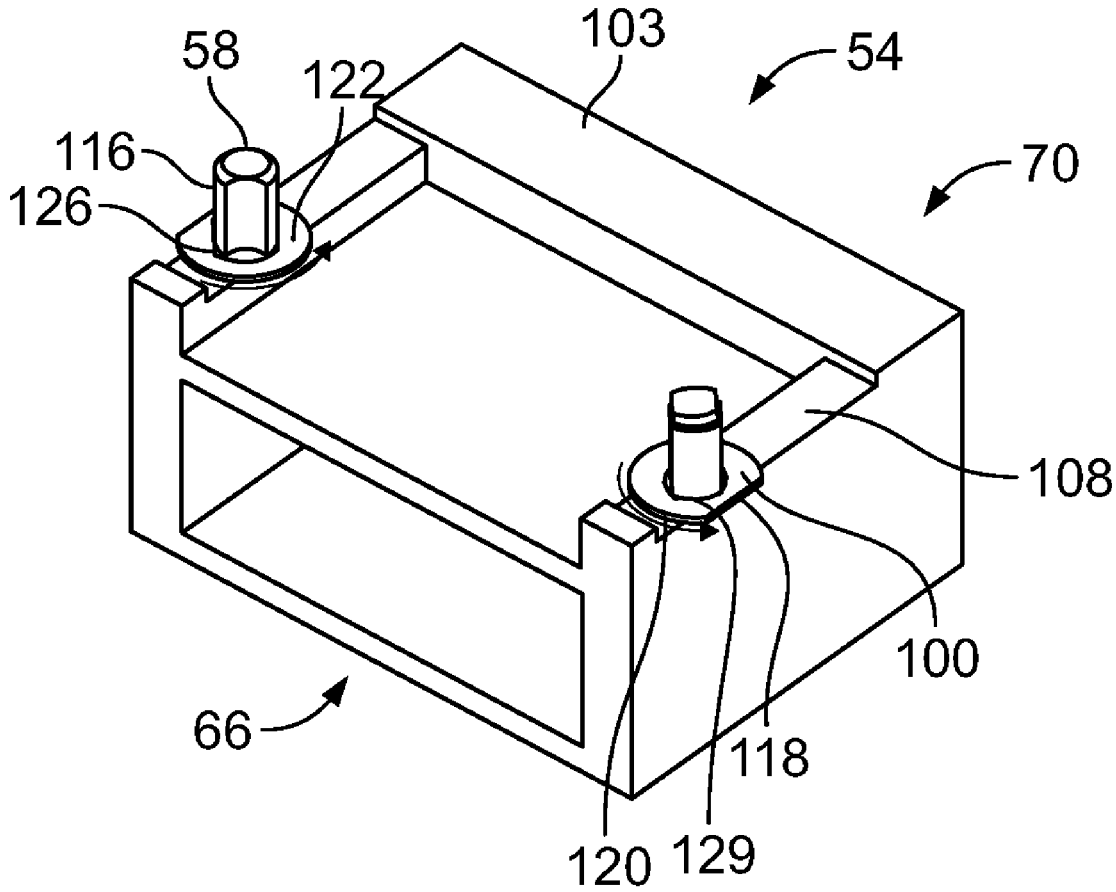
FIG. 6 illustrates a bottom perspective view of the connector and mounting plates, shown in FIG. 2, in an assembled position.

FIG. 6 illustrates a bottom perspective view of the connector 54 and mounting plates 100 in the assembled position 300. The mounting plates 100 rest on the plate surface 108. The second edge 118 of each mounting plate 100 is aligned with the edge 120 of one of the plate surfaces 108. The engagement feature 129 of each mounting plate 100 is embedded within the second contour 116 of a corresponding post 58 to create an interference fit between each mounting plate 100 and corresponding post 58.

The mounting surfaces 122 surround the corresponding post 58. Optionally, the mounting surfaces 122 may partially surround the post 58. The mounting surfaces 122 provide a surface proximate the mating end 66 of the connector 54 that can be mechanically coupled to the surface 68 of the circuit board 52. The mounting surfaces 122 may be soldered to the surface 68 of the circuit board 52 and/or coupled to the circuit board with tabs, notches, grooves, or the like. Mechanically coupling the connector 54 to the circuit board 52 via the mounting plate 100 provides a coupling force at the mating end 66 of the connector 54. The coupling force offsets forces imposed on the connector 54 when an electrical component is joined to the mating end 66 of the connector 54. The mounting plate 100 secures to the connector 54 and the circuit board 52 to prevent the connector 54 from being disengaged from the circuit board 52.

Figure 7:
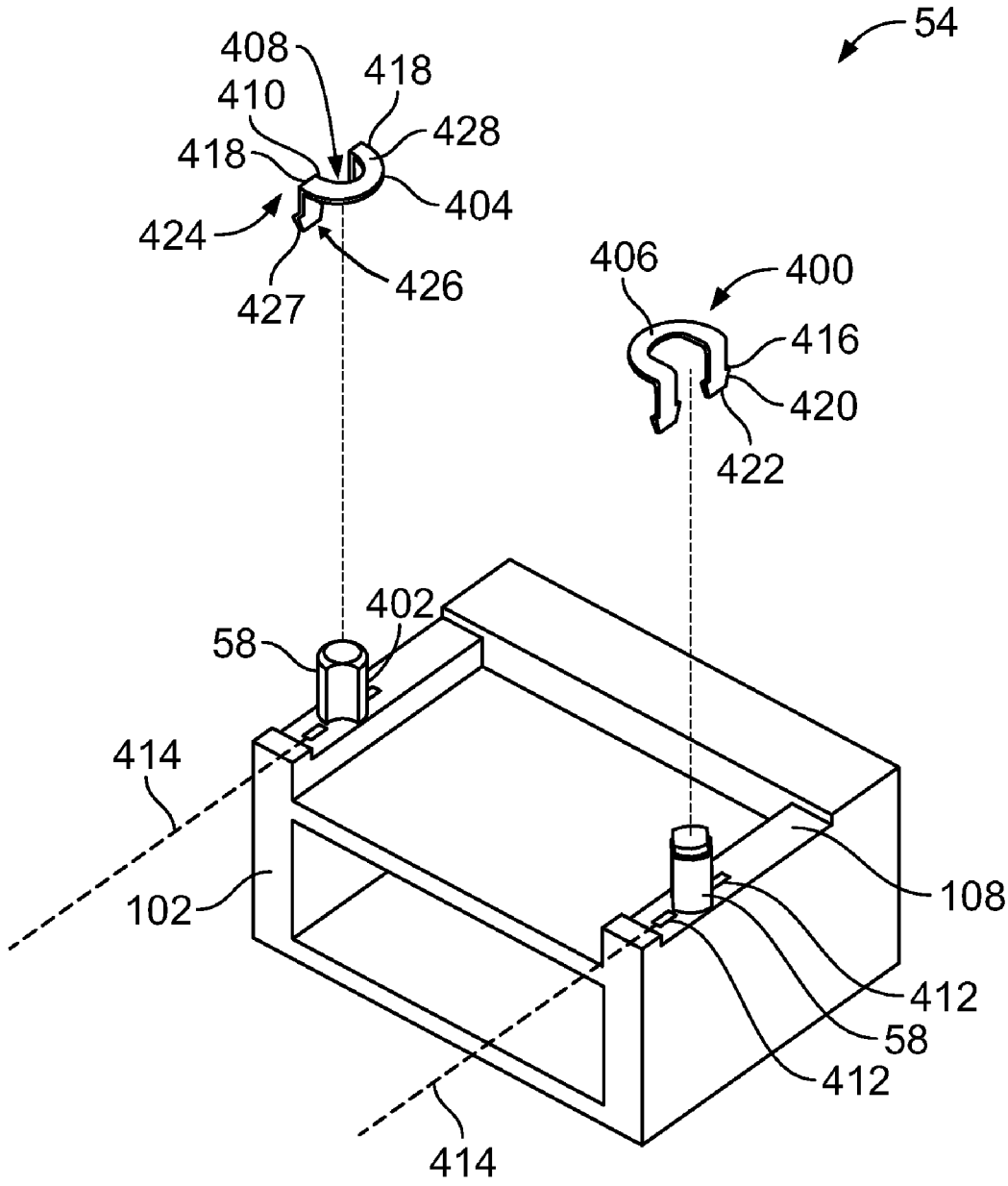
FIG. 7 illustrates a bottom perspective view of the connector, shown in FIG. 1, and other mounting plates in a pre-assembled position.

FIG. 7 illustrates a bottom perspective view of the connector 54 and a pair of mounting plates 400. The mounting plates 400 are configured to be positioned between the connector 54 and the circuit board 52 when the connector 54 is coupled to the circuit board 52. The mounting plates 400 engage the connector 54 through an interference fit. The mounting plates 400 have a mounting surface 406 for mechanically joining the connector 54 to the circuit board 52. The mounting plates 400 are configured to secure to the housing 102 so that the mounting surface 406 extends along the plate surface 108. The mounting surface 406 may be soldered to the circuit board 52.

The posts 58 extend from the plate surface 108. The posts 58 have a rounded contour 402. Alternatively, the contour 402 may have any linear and/or non-linear shape. The contour 402 may also be non-uniform. The posts 58 may include protrusions, notches, grooves, or the like to engage the mounting plate 400. A slot 412 is provided on each side of the posts 58. The slots 412 are formed in the plate surface 108 of the connector 54. In one embodiment, a slot 412 is only provided on one side of the post 58. The slots 412 may be aligned with a centerline 414 of the plate surface 108. Alternatively, the slots 412 may be formed at any intermediate location on the plate surface 108. The slots 412 may be misaligned. The slots 412 extend parallel to the centerline 414 of the plate surface 108. Alternatively, the slots 412 may extend at an angle with respect to the centerline 414. For example, the slots 412 may be perpendicular to the centerline 414.

The mounting plates 400 include a semi-circular disc 428 having a round outer contour 404. Optionally, the mounting plates 400 may have any shape, for example squared, hexagonal, or the like. The mounting surface 406 extends along the disc 428. The mounting surface 406 is planar and configured to engage the planar surface 68 of the circuit board 52. The mounting surface 406 provides a surface to mechanically couple the connector 54 to the circuit board 52. For example, the mounting surface 406 may provide a surface to solder the connector 54 to the circuit board 52. The mounting plates 400 may have a non-planar mounting surface 406. For example, the mounting surface 406 may be concave or convex. The mounting surface 406 may include protrusions, grooves, or the like. The mounting surface 406 may also include coupling mechanisms, for example, tabs, notches, slots, or the like, that engage corresponding coupling mechanisms formed on the circuit board 52.

The mounting plates 400 have an opening 408. The mounting surface 406 extends partially around the opening 408. The opening 408 is configured to circumscribe a portion of a post 58. The opening 408 has a rounded contour 410 that corresponds to the contour 402 of the post 58. The contours 410 may have any non-linear shape that corresponds to the contour 402 of the post 58. The mounting plates 400 are configured to circumscribe a post 58 so that the contours 410 abut a portion of a corresponding contour 402.

A pair of engagement features 416 extend substantially orthogonally from the disc 428 of the mounting plate 400. Alternatively, the engagement features 416 may extend at any angle with respect to the disc 428. An engagement feature 416 is illustrated on each side 418 of the disc 428. Alternatively, an engagement feature 416 may extend from only one side 418 of the disc 428. In another embodiment, an engagement feature 416 may extend from any intermediate location of the disc 428 between the sides 418. The number of engagement features 416 corresponds to the number of slots 412. The engagement features 416 are configured to engage the slots 412. The engagement features 416 have an orientation that corresponds to an orientation of the slots 412. For example, in the illustrated embodiment, the engagement features are orientated parallel to the centerline 414 of the plate surface 108.

An end 422 of each engagement feature 416 includes barbs 420 positioned thereon. The barbs 420 are tapered inward from a first end 424 to a second end 426. A step 427 is formed at the juncture of the engagement feature 416 and the first end 424 of the barb 420. The mounting plate 400 is positioned around the post 58 so that the barbs 420 are inserted into the slots 412. The engagement feature 416 extends entirely into the slot 412 so that the disc 428 of the mounting plate 400 rests on the plate surface 108. The barbs 420 displace material within the slot 412 to create an interference fit between the mounting plate 400 and the connector 54.

Figure 8:
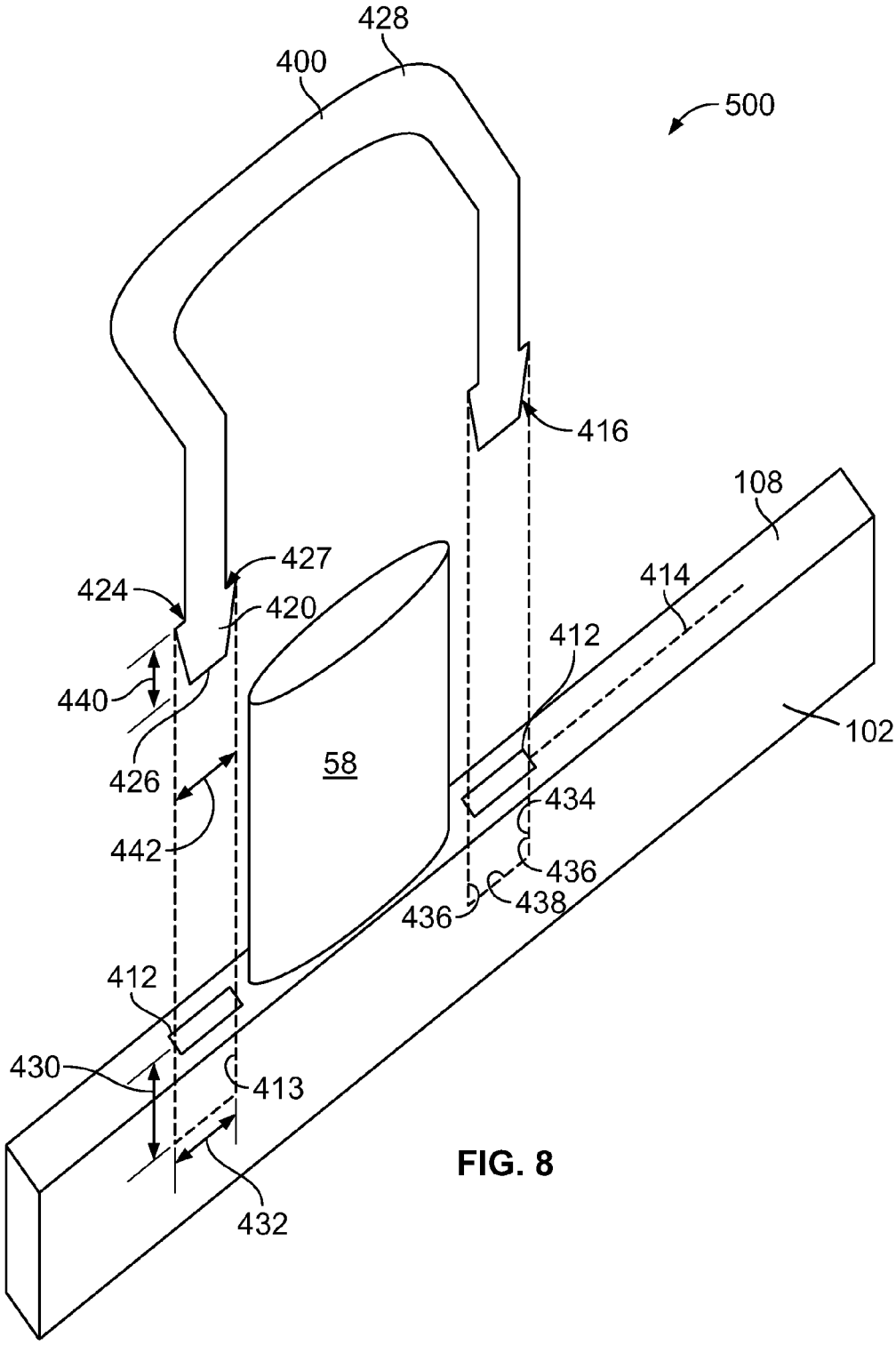
FIG. 8 illustrates a mounting plate and the connector, shown in FIG. 7, in a pre-assembled position.

FIG. 8 illustrates the mounting plate 400 and a portion of the connector housing 102 in a pre-assembled position 500. The slots 412 extend into the connector housing 102 through the plate surface 108. The slots 412 have a depth 430 and width 432. The slots 412 have an inner surface 434 defined by side surfaces 436 and a bottom surface 438. A plate securing portion 413 is defined by the inner surface 434 of the slots 412. The slots 412 are aligned with the centerline 414 of the plate surface 108. Optionally, the slots 412 may be positioned on any location of the plate surface 108. The slots 412 may also be orientated at an angle with respect to the centerline 414. The slots 412 are positioned proximate to the post 58 on each side of the post 58. In another embodiment, the plate surface 108 may include any number and/or arrangement of slots 412. For example, the plate surface 108 may have only one slot 412 or the plate surface 108 may have one slot 412 extending along the centerline 414 and another slot oriented at an angle with respect to the centerline 414.

The engagement features 416 of the mounting plate 400 are aligned with the slots 412. The engagement features 416 are configured to be received within a corresponding slot 412. The engagement features 416 have a length 440. In one embodiment, the length 440 is less than the depth 430 of the slots. In such an embodiment, the end 426 of each barb 420 does not contact the bottom surface 438 of the slot 412. Alternatively, the length 440 of each engagement feature 416 may be greater than the depth 430 of the slots 412. In such an embodiment, the end 426 of each barb 420 is configured to displace the plate securing portion 413 from the bottom surface 438 to create an interference fit between the mounting plate 400 and the slot 412. In other embodiments, the slots 412 may each have different depths 430 and the engagement features 416 may each have different lengths 440. The engagement features 416 are received into the corresponding slots 412 until the disc 428 rests on the plate surface 108.

The barbs 420 have a width 442 at the first end 424 of the barb 420. Each barb 420 may have a different width 442. The width 442 of each barb 420 is greater than the width 432 of the slots 412. The barbs 420 are configured to displace the plate securing portion 413 from the side surfaces 436 of the corresponding slots 412. The steps 427 of the barbs 420 are configured to embed with the side surfaces 436 of the slots 412. The barbs 420 create an interference fit with the slots 412 to retain the mounting plate 400 on the connector 54. In alternative embodiments, the engagement features 416 of the mounting plate 400 may include teeth, notches, ribs, and/or any other feature that displaces material from the inner surface 434 of the slot 412.

Figure 9:
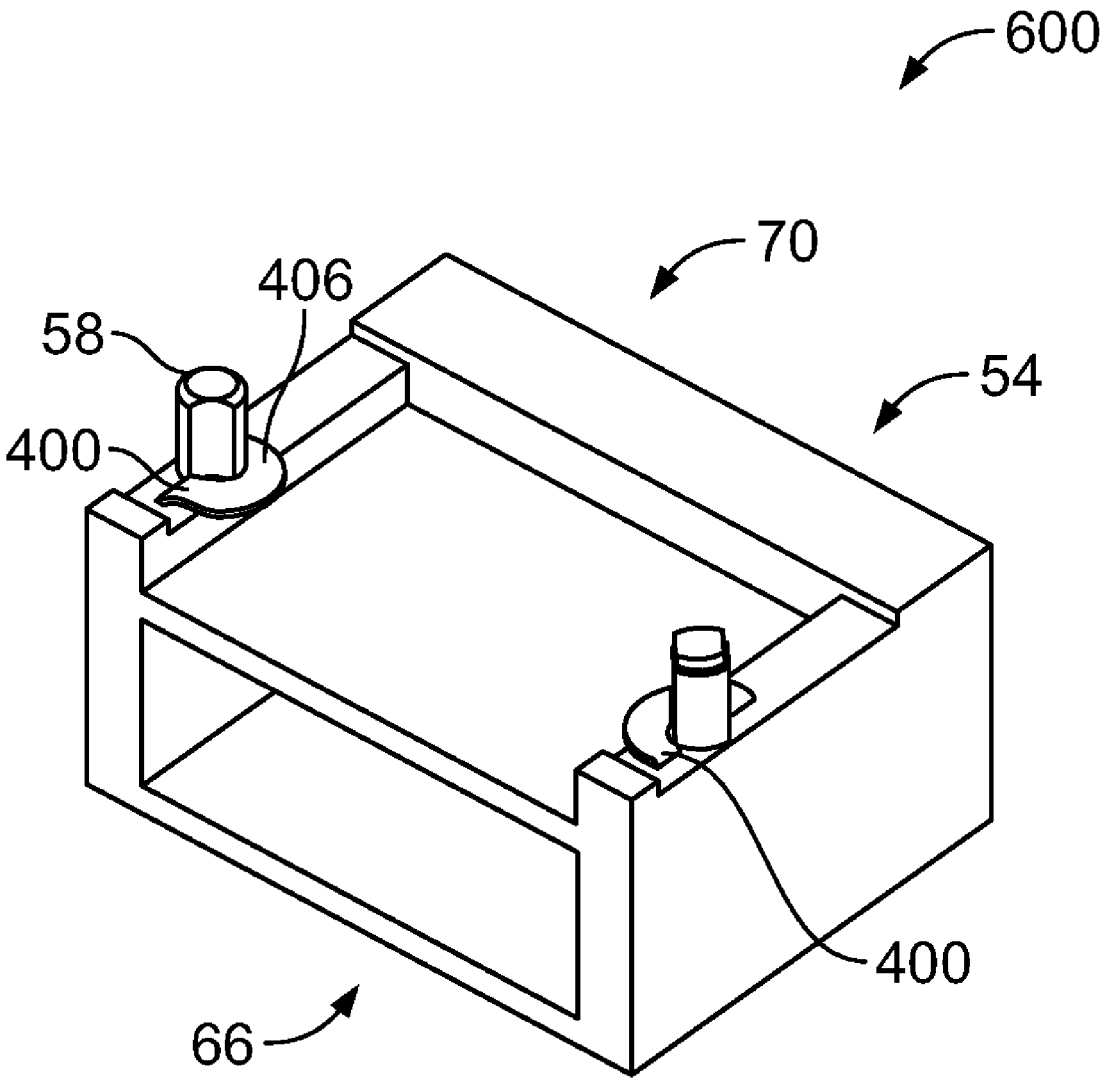
FIG. 9 illustrates a bottom perspective view of the connector, and the mounting plates, shown in FIG. 7, in an assembled position.

FIG. 9 illustrates a bottom perspective view of the connector 54 and the mounting plate 400 in an assembled position 600. The engagement features 416 of each mounting plate 400 are positioned within a respective slot 412. The barbs 420 have displaced the plate securing portion 413 along the inner surface 434 of the slot 412. The barbs 420 are embedded within the inner surface 434. The barbs 420 create an interference fit between the engagement features 416 and the corresponding slots 412. The steps 427 of each engagement feature 416 further lock the engagement feature 416 within the slot 412. The engagement features 416 retain the mounting plates 400 on the connector 54.

The mounting surfaces 406 partially surround the corresponding post 58. The mounting surfaces 406 provide a surface proximate to the mating end 66 of the connector 54 that can be mechanically coupled to the surface 68 of the circuit board 52. The mounting surfaces 406 may be soldered to the surface 68 of the circuit board 52 and/or coupled to the circuit board with tabs, notches, grooves, or the like. Mechanically coupling the connector 54 to the circuit board 52 via the mounting plate 400 provides a coupling force at the mating end 66 of the connector 54. The coupling force offsets forces imposed on the connector 54 when an electrical component is joined to the mating end 66 of the connector 54. The mounting plate 400 secures to the connector 54 and the circuit board 52 to prevent the connector 54 from being disengaged from the circuit board 52.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a housing having a mating end and a back end, the housing having a plate surface extending between the mating end and the back end, a post extending from the plate surface and configured to mount within an aperture provided on a circuit board;

a mounting plate having a mounting surface configured to be mechanically coupled to the circuit board, an opening extending through the mounting plate, the opening having an interior contour shaped to slidably receive the post as the mounting plate is loaded onto the post until the mounting plate rests on the plate surface of the housing; and an engagement feature provided on the mounting plate, the engagement feature securing the mounting plate to the housing, the engagement feature displacing a plate securing portion formed on the housing to secure the mounting plate to the housing with an interference fit, wherein the mounting plate is rotated to create the interference fit between the engagement feature and the housing.

2. The electrical connector of claim 1, wherein the engagement feature is defined by a non-uniform contour about the opening.

3. The electrical connector of claim 1, wherein the opening is defined by a first contour and a second contour, the engagement feature defined by one of the first contour or the second contour.

4. The electrical connector of claim 1, wherein the opening is defined by at least one linear segment and at least one arcuate segment, the engagement feature defined by the at least one linear segment.

5. The electrical connector of claim 1, wherein the mounting plate slides along a length of the post to load the mounting plate into an unsecured position in which the mounting plate engages and rests on the plate surface of the housing.

6. The electrical connector of claim 1, wherein once the mounting plate rests on the housing, the mounting plate is rotated about the post such that the engagement feature displaces the plate securing portion of the housing to create the interference fit between the mounting plate and the housing.

7. The electrical connector of claim 1, wherein the plate securing portion of the housing is defined by a non-uniform contour of the post.

8. An electrical connector comprising:

a housing having a mating end and a back end, the housing having a plate surface extending between the mating end and the back end, a post being integral with the housing and extending from the plate surface and configured to mount within an aperture provided on a circuit board;

a mounting plate having a mounting surface configured to be mechanically coupled to the circuit board, the mounting plate securing the electrical connector to the circuit board, an opening extending through the mounting late the opening having an interior contour shaped to slidably receive the post prior to the housing being loaded onto the circuit board and the post being loaded into the aperture of the circuit board, the mounting plate being loaded onto the post until the mounting plate rests on the plate surface of the housing; and an engagement feature provided on the mounting plate, the engagement feature securing the mounting plate to the housing, the engagement feature displacing a plate securing portion formed on the housing to secure the mounting plate to the housing with an interference fit, wherein the engagement feature is defined by a barb that is inserted into a slot formed in the housing.

9. The electrical connector of claim 8, wherein the slot is formed in the plate surface of the housing, the plate securing portion defined by an inner surface of the slot.

10. The electrical connector of claim 8, wherein the engagement feature extends at an angle from the mounting plate.

11. The electrical connector of claim 8, wherein the mounting surface is soldered to the circuit board to secure the housing to the circuit board.

12. An electronic assembly comprising:

a circuit board having a surface and an aperture extending through the surface;

an electrical connector including a housing having a mating end and a back end, the housing having a plate surface extending between the mating end and the back end, a post extending from the plate surface and configured to mount within the aperture of the circuit board;

a mounting plate having a mounting surface configured to be mechanically coupled to the circuit board, an opening extending through the mounting plate, the opening having an interior contour shaped to slidably receive the post as the mounting plate is loaded onto the post until the mounting plate rests on the plate surface of the housing; and an engagement feature provided on the mounting plate, the engagement feature securing the mounting plate to the housing, the engagement feature displacing a plate securing portion formed on the housing to secure the mounting plate to the housing with an interference fit, wherein the engagement feature is defined by a non-uniform contour about the opening.

13. The electronic assembly of claim 12, wherein the opening is defined by a first contour and a second contour, the engagement feature defined by one of the first contour or the second contour.

14. The electronic assembly of claim 12, wherein the opening is defined by at least one linear segment and at least one arcuate segment, the engagement feature defined by the at least one linear segment.

15. The electronic assembly of claim 12, wherein the mounting plate slides along a length of the post to load the mounting plate into an unsecured position in which the mounting plate engages and rests on the plate surface of the housing.

16. The electronic assembly of claim 12, wherein once the mounting plate rests on the housing, the mounting plate is rotated about the post such that the engagement feature displaces the plate securing portion of the body to create the interference fit between the mounting plate and the housing.

17. The electronic assembly of claim 12, wherein the plate securing portion of the body is defined by a non-uniform contour of the post.

18. The electronic assembly of claim 12, wherein the engagement feature is defined by a barb that is inserted into a slot formed in the housing.

19. The electronic assembly of claim 12, further comprising a slot formed in the plate surface of the housing, the plate securing portion defined by an inner surface of the slot.

* * * * *

UNITED STATES PATENT AND TRADEMARK OFFICE

CERTIFICATE OF CORRECTION

PATENT NO. : 8,210,872 B2
APPLICATION NO. : 12/841322
DATED : July 10, 2012
INVENTOR(S) : Eric David Briant et al.

It is certified that error appears in the above-identified patent and that said Letters Patent is hereby corrected as shown below:

Title Page, item (75) Inventors, line 1, change "James Charles Schiffler" to "James Charles Shiffler"

Signed and Sealed this
Fourteenth Day of August, 2012

David J. Kappos

David J. Kappos
*Director of the United States Patent and Trademark Office*